United States Patent [19]

Crowley

[11] Patent Number: 5,065,992

[45] Date of Patent: Nov. 19, 1991

[54] METHOD FOR PROCESSING WEB MATERIAL

[75] Inventor: H. W. Crowley, Newton, Mass.

[73] Assignee: Roll Systems, Inc., Burlington, Mass.

[21] Appl. No.: 534,724

[22] Filed: Jun. 7, 1990

[51] Int. Cl.[5] ..... B41L 1/32

[52] U.S. Cl. ..... 270/39; 270/1.1; 270/52; 493/412; 493/357

[58] Field of Search ..... 270/1.1, 39, 31, 40, 270/41, 52; 493/410–415, 357

[56] References Cited

U.S. PATENT DOCUMENTS

| | | | |
|---|---|---|---|
| 3,406,959 | 10/1968 | Ross | 493/413 |
| 4,758,215 | 7/1988 | Kogane | 493/357 |
| 4,824,426 | 4/1989 | DuFrense | 270/39 |
| 4,854,932 | 8/1989 | Schlottke | 493/357 |
| 4,874,158 | 10/1989 | Retzloff | 270/39 |
| 4,928,940 | 5/1990 | Dash | 270/39 |

*Primary Examiner*—Edward K. Look
*Assistant Examiner*—Therese M. Newholm
*Attorney, Agent, or Firm*—Wolf, Greenfield & Sacks

[57] ABSTRACT

A method for sorting, separating and indicating sections of an outputted stack, such as printed continuous paper web. A continuous web is outputted which includes a plurality of sections having pages therein. Page separation and section separation locations are determined upon the web wherein the size of each page in a section is equal and wherein the size of at least one section separator page disposed adjacent to a section separation location is unequal to the size of the other pages in the section. The web is folded at each of the subsequent page separation locations upon an alternating face to produce a zig-zag pattern. The section separator pages may be folded so that their size is greater than or less than the size of the pages in the section and the section separator pages may be cut so that their size is greater than or less than that of the pages in the section. The area of a section separator page overlapping or indented from the pages in the section may contain information descriptive of the section contents.

34 Claims, 2 Drawing Sheets

METHOD FOR PROCESSING WEB MATERIAL

BACKGROUND OF THE INVENTION

1. Field of Invention

This invention relates to a method and apparatus for sorting and separating sections in an outputted stack of printed continuous paper web and more particularly to a method and apparatus in which a stack is folded or cut at predetermined locations that vary in page length size depending upon how the pages or sections are to be separated, stacked, indicated and tabbed.

2. Background of Invention

There is a great need when producing printed matter in volume to combine, sectionalize, and otherwise sort the material into identifiable bundles. This operation is sometimes referred to generally as "binding". The traditional form of binding involves the joining together of separate leaves of paper along one edge such that the paper may be opened and paged through on the opposite end. Tabs may often be placed either in indented form, for a finger to catch while quickly thumbing through pages, or in extended form relative to an exposed edge of the bound paper to divide section. These tabs may often contain printed material or some other way of indicating a given section of the total bound material.

With the advent of continuous paper printing, especially in computer applications, a binding operation may also take the form of the production of a zigzagged stack of paper printout. Equipment now exists to fold and separate the stack into separate bundles of zig zag paper representative of different sections of a document or different printing jobs, but the overall length of each page in the zig zag, including the cover and section break pages, is always equal. This even length results from the use by the folder/separator of only the evenly spaced perforations pre cut on each page. Devices for folding of zig zag paper along its perforations are disclosed in U.S. Pat. Nos. 4,871,157, 4,846,454, 4,842,572, 4,778,165 and 4,730,762. Like the separator, these folders also have no provision for varying the lengths of folded sheets of paper. Rather, as discussed above, they rely only upon the existence of pre cut perforations placed at equal intervals upon the paper web. To indicate sections, they utilize offset stacking or an external tab that is inserted into the stack. Thus, the prior art lacks provision for the production of paper that is folded or cut in various page length sizes different from that of the pre cut perforated page size. These prior disclosures produce no tabbing or other means for indicating various sections or jobs in a continuous output of stacked and folded material and their zig zag paper stands in a uniform stack of output having no rapid means for identifying individual sections or jobs. Additionaly, the external tabs or offsets used by these devices have a tendency to fall off while offsets may slip back together.

SUMMARY OF THE INVENTION

It is, therefore, an object of this invention to provide a method for sorting and separating sections in an outputted stack of continuous web that may fold non perforated material into stackable zig zags with variable lengths between folds.

A further object of this invention is to provide a method for sorting and separating that allows differing sized pages serving as indentations and tabs containing printing or other indicators to be placed between sections in a stack of folded material such as paper.

A further object of this invention is to provide a method for sorting and separating that can cut pages of various lengths to be placed between sections including cutting various lengths that allow tabs and indented sections to be created.

It is yet another object of this invention to provide a method for altering the lengths of pages in separate sections in a continuous stack in order to more quickly identify various sections of an otherwise continuous stack of material.

To accomplish the foregoing and other objects of this invention, there is provided, in accordance with one aspect thereof, a method for sorting, separating and indicating sections of an outputted stack of continuous web comprising the steps of the outputting of a continuous web including a plurality of sections having pages therein. There is the further step of determining page separation and section separation locations upon the web, wherein the size of each page in a section is equal and wherein the size of section separator pages is unequal to the size of the pages in the section. There is further provided the step of folding the web at each page separation location so that each consecutive fold is placed upon an alternating face of the web to produce a zig-zag pattern. In one of the preferred embodiments, a section separator page may be folded so that its size is greater than that of the size of the pages in the section. The section separator page may also be folded so that its size is less than that of the pages in the section. In another embodiment the section separator page may be cut so that its size is either greater than or less than that of the pages in the section. In either of the above embodiments involving the cutting or folding of paper, section separator pages may contain information descriptive of the section contents thereon.

In another embodiment the section separator page may be folded so that the pages of an adjoining second section are of equal size to the section separator page to produce a tiered effect between adjoining sections. The area in the tier that overlaps the preceding section may contain information descriptive of the section contents thereon. Where the folding step produces a section separator page with a size greater than the pages in the section, the page of an adjoining second section may be equal in size to the section separator page to produce a folded tab page. Similarly, where the section separator page has a size less than the pages in the section, the page of an adjoining second section may have equal size to the section separator page to produce a folded indent page. Finally, where section separator pages at opposite ends of a section have a size less than that of the pages in the section, pages of a second and a third section adjoining these respective section separator pages may have size greater than the respective section separator pages to produce an offset between adjoining sections. An area located at at least one end of the section that overlaps one of the second and third sections may contain information descriptive of the section contents.

BRIEF DESCRIPTION OF THE DRAWING

Other objects, features and advantages will occur to those skilled in the art from the following description of the preferred embodiments and the accompanying drawings in which.

DETAILED DESCRIPTION OF THE PREFERRED EMBODIMENT

Figure 9:
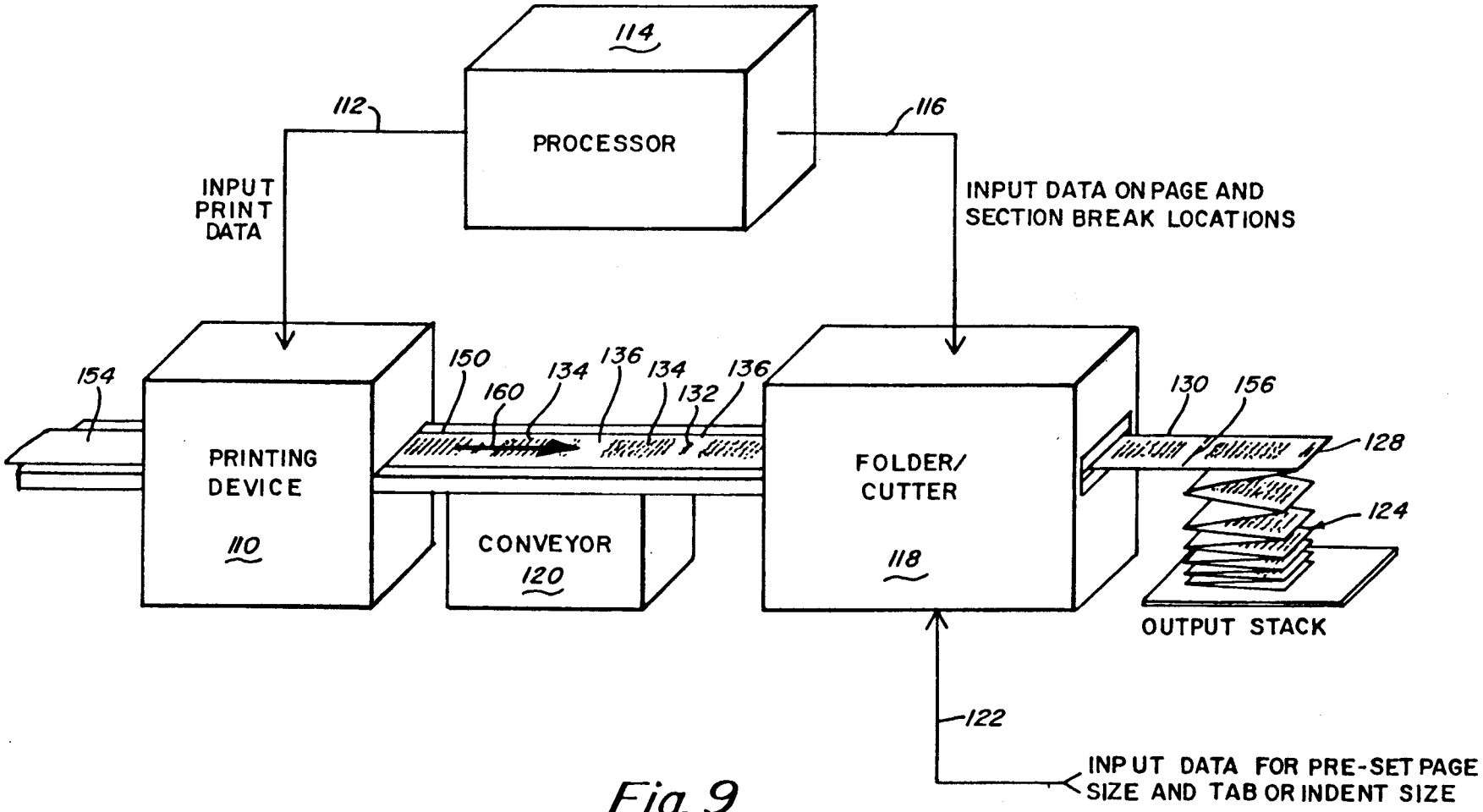
FIG. 9 is a schematic diagram of a printing system utilizing a method for sorting and separating according to this invention.

A system to produce sorted and separated stacks of zig-zag paper is schematically depicted in FIG. 9. A continuous stream of paper travelling in a single direction 160 from an input source 154 is fed to a printing device 110 that lays down text or other graphical representations onto the blank paper. The contents, spacing and locations of the text are determined by print data at line 112 input from a data processing unit 114. Simultaneously, the data processing unit develops data relating to the locations of page breaks and section breaks at line 116 relative to the text printed. The printed paper 150 is subsequently conveyed by conveyor 120 to the folder/-cutter apparatus 118. The folder/cutter 118 receives control data (line 116) from the processing unit 114 instructing it when to fold, extend or shorten page length based upon the occurrence of various signals from the processing unit 114. The folder/cutter, thus, outputs a stream of zig-zag paper 130, with fold lines 156, that falls into an output stack 124. The folder/cutter may receive input from a separate source 122 relating to the exact pre set size of each page and tab or indent to be produced when signalled by the processor to perform such an operation.

In this depiction, the printed paper 150 entering the folder/cutter 118 contains text layed down by the printing device. Each grouping of text 134 corresponds to a page of output when the folding operation occurs, the blank areas between groupings corresponding to page breaks 136 upon which folds are made. Where a small amount of text appears following the main page text 134, a tab marking 132 may be indicated. The tab markings appear at the edge of the page beyond the normal page length. The folder/cutter 118 adjusts its fold or cut location for this page so that the tab marking will appear on the page as an extension beyond normal page length. An outputted gage with an extended tab 128 is shown exiting the folder/cutter.

Figure 1:
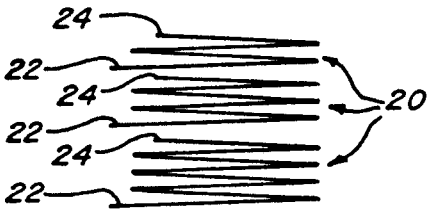
FIG. 1 is a stack of uniformly folded and cut paper with tabs and indentations cut in pages between each grouping.

The output of a method for sorting and separating various sections of a stack of printed material is depicted in FIG. 1. In this embodiment, three zig zag folded sections 20 are shown, each consisting of a differing number of pages. On the uppermost end of each separate grouping of pages, the top page has been cut to a shorter size to form a first page indent 24. Similarly, the bottommost end page, the section separator page, of each grouping has been cut to a longer size than the preceding pages in the stack in order to form tabs 22. The "slack" from the shorter top page may be "taken up" by the longer tab page in this example. This allows the further page folds to fall upon standard pre-cut fold locations while still enabling the production of tabs. However, this method of sorting and separating does not generally necessitate any pre-perforations or cuts of paper. Rather, all folding and cutting may occur at the time the paper is output based upon predetermined but uncut locations corresponding to the text that comprises desired page breaks and beginning and end of sections. In this embodiment, the pages in each grouping 20 are all zig zag folded to the same general width with the exception of the tabbed and indented pages.

Figure 2:
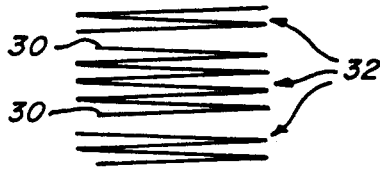
FIG. 2 is a stack of uniformly folded and cut paper with only indentations cut in pages between each grouping.

A similar uniform width folded set of pages is shown in FIG. 2. However, in each of these groupings 32, no extended tabs have been produced. Rather, only indentations 30 have been folded into the section separator pages on the tops and bottoms of certain groupings. Printed matter on the section separator pages may be predetermined to conform to the size of the indentations and tabs in order to allow quick reading or other methods of locating an individual grouping of zig zag folded material, such as color coding.

Figure 3:
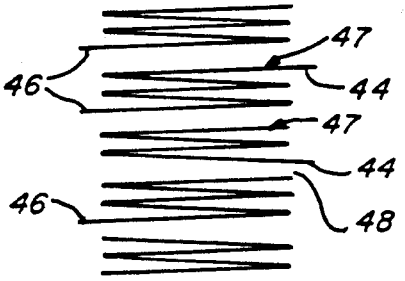
FIG. 3 is a stack of uniformly folded and cut paper with only tabs cut in pages between each grouping wherein the tabs mag be placed upon either side of the grouping.

Another fold method also utilizing uniformly folded pages may involve the exclusive use of tabs on various preselected tops and bottoms of folded groupings. Such utilization is depicted in FIG. 3. Here, various tabs 46 with different sizes may be cut to protrude from the left side of a stack as shown and also may be cut to protrude on the right side 44 of the stack as shown. Non-tabbed ends may be generally cut to conform to other zig zag page lengths as shown by a page at the top of a grouping without an alternating top tab. Note also that FIG. 3 shows some examples of folds 47 in which the cut is taken advantage of to reverse the direction in which the folds face. As a result, subsequent pages face up rather than down and down rather than up.

In all of the above embodiments, both folding and cutting operations occur. Generally, the length between folds of pages in these above embodiments is equal while cuts are made with an automatic cutting knife edge operating at various page lengths different from the usual page length to produce the section separator pages. Thus, tabs and indentations may be formed in an otherwise uniform stack of paper specifically by the operation of a cutting unit as part of this method.

Figure 4:
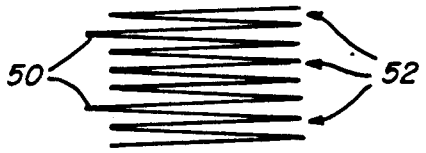
FIG. 4 is a stack of variable length folded continuous paper with tab indicators folded therein.

In another embodiment, the paper may be stacked without any cuts as one continuous length of zig zag folded material in which lengths of the various folds may themselves be altered. FIG. 4 depicts a general output of folded material in a continuous zig-zag pattern in which, upon one side of the stack, certain folds 50 between groupings 52 extend outward from the stack further than the general page size. Each page of these folds now forms a section separator page and each may contain on its extended face other predetermined information or indicators describing the contents of the various groupings.

Figure 5:
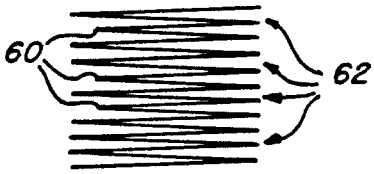
FIG. 5 is a stack of variable length folded continuous paper with indentations folded therein.

In a second variable fold alternative, as shown in FIG. 5, the groupings 62 may be separated by indented folds 60 extending not as wide as the general zig zag page size. Again, various information or indicators may be placed upon these indented pages to distinguish the various groupings as sections are lifted away with thumb location of the indent.

Figure 6:
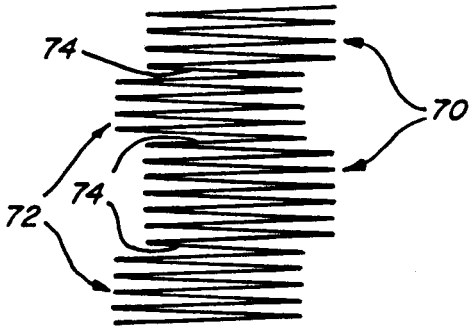
FIG. 6 is a stack of variable length folded continuous paper with alternating offsets of groupings folded therein.

In yet another alternative of the continuous fold embodiment as described in FIG. 6, entire groupings of paper may extend outward in alternating left 72 and right 70 offsets. Between each of the offset groupings there are section separator pages 74 that are folded shorter by differing amounts upon the upper and lower faces of every other grouping in order to create the offset pattern. Upon one of the over-extended faces of the offset, where the overlap is clearly visible, may appear various predetermined indicators or information pertaining to the contents of that specific grouping.

Figure 7:
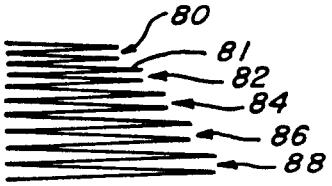
FIG. 7 is a stack of variable length folded continuous paper with step increases in fold length size for all pages of each grouping.

In another alternative of the variable fold embodiment, each grouping may be folded, viewing from stack top to bottom, such that the uppermost fold of the next lower grouping extends beyond the length of page folds of the preceding grouping and every preceding fold within that next grouping matches its first uppermost fold such that a tiered arrangement for each grouping is created. FIG. 7 depicts a tiered arrangement with groupings 80, 82, 84, 86 and 88 where each grouping is, from top to bottom, progressively more extended than the one preceding it. The initial extended face of each grouping as shown, for example, by the uppermost over-extended face 81, may contain thereon printing or indicators at its edge describing the contents of tiered group which, in this example is the second uppermost grouping 82. The tiering can occur either to the right, to the left, or, in fact, both left and right as a pyramid-type stepping, with indicators potentially placed upon both over-extended faces.

Figure 8:
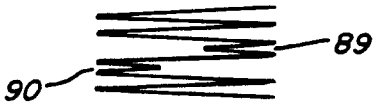
FIG. 8 is a stack of variable length folded continuous paper, similar to that in FIG. 6, but having tabs in close proximity.

Finally, in the last depicted alternative of the variable fold geometry embodiment in FIG. 8, the folds 89 and 90 may be place in close proximity. This serves to diminish the occurrence of blank, wasted, pages. This also serves to expose pages between the folds 89 and 90 that might otherwise be missed in sorting through the stack. A short sized fold having printing placed upon it may effectively highlight or compliment the adjacent page.

All folds and cuts depicted herein have occurred at right angles to the web's side edges. However, various angles other than 90° may be contemplated to produce interesting and potentially useful results.

Having now described the limited embodiments of the present invention, it should now be apparent to those skilled in the art that numerous other embodiments and modifications, thereof, are contemplated as falling within the scope of the present invention as defined by the appended claims. For example, many of the stacks depicted in FIGS. 1–8 may be combined to form alternative stacking arrangements with tabs and indentations.

What is claimed is:

1. A method for sorting, separating and indicating sections of an outputted stack of printed continuous paper web comprising the steps of:

outputting a continuous paper web including a plurality of sections having pages therein;

determining page separation and section separation locations upon the web, wherein the size of each page in a section is equal;

determining section separation locations upon the web wherein the size of at least one section separator page disposed adjacent to a section separation location is unequal to the size of the pages in the section, the section separator page containing information descriptive of the section contents; and folding the web at each of the page separation locations so that each consecutive fold is placed upon a alternating face of the web to produce a zig-zag pattern.

2. The method of claim 1 further comprising the step of folding the section separator page so that its size is greater than the size of the pages in the section.

3. The method of claim 2 wherein an area of the section separator page that overlaps the pages in the section contains information descriptive of the section contents.

4. The method of claim 1 further comprising the step of folding the section separator page so that its size is less than that of the pages in the section.

5. The method of claim 4 wherein the page of a second section that adjoins the section separator page is equal in size to the section separator page to produce a folded indent page.

6. The method of claim 1 further comprising the step of cutting the section separator page so that its size is greater than that of the pages in the section.

7. The method of claim 6 wherein an area of the section separator page that overlaps the pages in the section contains information descriptive of the section contents.

8. The method of claim 1 further comprising the step of cutting the section separator page so that its size is less than that of the pages in the section.

9. A method for sorting, separating and indicating sections of an outputted stack of printed continuous paper web comprising the steps of:

outputting a continuous paper web including a plurality of sections having pages therein;

determining page separation and section separation locations upon the web, wherein the size of each page in section is equal;

determining section separation locations upon the web wherein the size of at least one section separator page disposed adjacent to a section separation location is unequal to the size of the pages in the section;

folding the section separator page so that its size is greater than the size of the pages in the section;

folding the web at each of the page separation locations so that each consecutive fold is placed upon an alternating face of the web to produce a zig-zag pattern, wherein the pages of an adjoining second section are of equal size to the section separator page to produce a tiered effect between adjoining sections.

10. The method of claim 9 wherein an area of the section separator page that overlaps the pages in the section contains information descriptive of the section contents.

11. A method for sorting, separating and indicating sections of an outputted stack of printed continuous paper web comprising the steps of:

outputting a continuous paper web including a plurality of sections having pages therein;

determining page separation and section separation locations upon the web, wherein the size of each page in a section is equal;

determining section separation locations upon the web wherein the size of at least one section separator page disposed adjacent to a section separation location is unequal to the size of the pages in the section;

folding the section separator page so that its size is greater than the size of the pages in the section;

folding the web at each of the page separation locations so that each consecutive fold is placed upon an alternating face of the web to produce a zig-zag pattern, wherein the page of a second section that adjoins the section separator page is equal in size to the section separator page to produce a folded tab page.

12. A method for sorting, separating and indicating sections of an outputted stack of printed continuous paper web comprising the steps of:

outputting a continuous paper web including a plurality of sections having pages therein;

determining page separation and section separation locations upon the web, wherein the size of each page in a section is equal; determining section separation locations upon the web wherein the size of at least one section separator page disposed adjacent to a section separation location is unequal to the size of the pages in the section;

folding the section separator page so that its size is greater than the size of the pages in the section;

folding the web at each of the page separation locations so that each consecutive fold is placed upon an alternating face of the web to produce a zig-zag pattern, wherein the page of a second and third section adjoining respective section separator pages on opposite ends of the section have a size greater than respective section separator pages to produce an offset between adjoining sections.

13. The method of claim 12 wherein at least one area at the end of the section, that overlaps one of the second and third sections, contains information descriptive of the section contents.

14. A method for sorting, separating and indicating sections of an output web comprising the steps of:

outputting a web including a plurality of sections having pages therein;

determining page separation and section separation locations upon the web wherein the size of at least one section separator page is unequal to the size of the pages in the section, at least one section separator page containing information descriptive of the section contents; and folding the web at each of the page separation locations so that further folds are placed upon an alternating face of the web to produce an alternating pattern.

15. The method of claim 14 further comprising the step of folding at least one section-separator page so that its size is greater than the size of the pages in the section.

16. The method of claim 14 further comprising the step of folding at least one section separator page so that its size is less than that of the pages in the section.

17. The method of claim 16 wherein the size of the section separator page is within a range between a substantially smaller size than a page and a size nearly as large as a page.

18. The method of claim 17 wherein the pages of a section that adjoin section separator pages are equal in size to the section separator page to produce a folded indent page.

19. The method of claim 17 wherein the pages of additional sections adjoining respective section separator pages on opposite ends of a section have sizes greater than the respective section separator pages to product an offset between adjoining sections.

20. The method of claim 19 wherein at least one area at the end of the section, that overlaps one of the other sections, contains information descriptive of the section contents.

21. The method of claim 14 further comprising the step of cutting at least one section separator page so that its size is greater than that of the pages in the section.

22. The method of claim 14 further comprising cutting at least one section separator page so that its size is less than that of the pages in the section.

23. The method of claim 22 wherein said step of cutting includes a section separator page that is removable.

24. The method of claim 14 further comprising at least one of the steps of folding and cutting of section separator pages of different sizes to indicate different types of sections.

25. A method for sorting, separating and indicating sections of an output web comprising the steps of:

outputting a web including a plurality of sections having pages therein;

determining page separation and section separation locations upon the web wherein the size of at least one section separator page is unequal to the size of the pages in the section;

folding the web at each of the page separation locations so that further folds are placed upon an alternating face of the web to produce an alternating pattern; and folding at least one section separator page so that its size is greater than the size of the pages in the section, wherein an area of at least one section separator page contains information descriptive of the section contents.

26. A method for sorting, separating and indicating sections of an output web comprising the steps of:

outputting a web including a plurality of sections having pages therein;

determining page separation and section separation locations upon the web wherein the size of at least one section separator page is unequal to the size of the pages in the section;

folding the web at each of the page separation locations so that further folds are placed upon an alternating face of the web to reduce an alternating pattern; and folding at least one section separator page so that its size is greater than that of the pages in the section, wherein an area of the section separator page contains information descriptive of the section contents.

27. A method for sorting, separating and indicating sections of an output web comprising the steps of:

outputting a web including a plurality of sections having pages therein;

determining page separation and section separation locations upon the web wherein the size of at least one section separator page is unequal to the size of the pages in the sections; and folding at least one section separator page so that its size is greater than the size of the pages in the section, wherein the pages of an adjoining section are of equal size to the section separator page between them to produce a tiered effect between adjoining sections.

28. The method of claim 27 wherein an area of the section separator page contains information descriptive of the section contents.

29. A method for sorting, separating and indicating sections of an output web comprising the steps of:

outputting a web including a plurality of sections having pages therein;

determining page separation and section separation locations upon the web wherein the size of at least one section separator page is unequal to the size of the pages in the sections; and folding at least one section separator page so that its size is greater than the size of the pages in the section, wherein the pages of a section that adjoins a section separator page are equal in size to the section separator page to produce a folded tab.

30. A method for sorting, separating and indicating sections of an output web comprising the steps of:

outputting a web including a plurality of sections having pages therein;

determining page separation and section separation locations upon the web wherein the size of at least one section separator page is unequal to the size of the pages in the section;

folding the web at each of the page separation locations so that further folds are placed upon an alternating face of the web to produce an alternating pattern; and at least one of folding and cutting of section separator pages to produce tabs and indents upon opposite ends of the pages.

31. The method of claim 30 wherein the placement of one of tabs and indents upon said opposite ends is indicative of different types of sections.

32. A method for sorting, separating and indicating sections of an output web comprising the steps of:

outputting a web including a plurality of sections having pages therein;

determining page separation and section separation locations upon the web wherein the size of at least one section separator page is unequal to the size of the pages in the section;

folding the web at each of the page separation locations so that further folds are placed upon an alternating face of the web to produce an alternating pattern; and cutting section separator pages to reverse the facing direction of subsequent further folded pages.

33. A method for sorting, separating and indicating sections of an output web comprising the steps of:

outputting a web including a plurality of sections having pages therein;

determining page separation and section separation locations upon the web wherein the size of at least one section separator page is unequal to the size of the pages in the section;

folding the web at each of the page separation locations so that further folds are placed upon an alternating face of the web to produce an alternating pattern; and folding at least one of pages and section separator pages at angles of other than 90° relative to a side edge of the web.

34. A method for sorting, separating and indicating sections of an output web comprising the steps of:

outputting a web including a plurality of sections having pages therein;

determining page separation and section separation locations upon the web wherein the size of at least one section separator page is unequal to the size of the pages in the section;

folding the web at each of the page separation locations so that further folds are placed upon an alternating face of the web to produce an alternating pattern; and cutting at least one of pages and section separator pages at an angle other than 90° relative to a side edge of the web.

* * * * *